US008254526B2

(12) United States Patent
Hauttmann

(10) Patent No.: US 8,254,526 B2
(45) Date of Patent: Aug. 28, 2012

(54) THERMIONIC ELECTRON EMITTER AND X-RAY SOURCE INCLUDING SAME

(75) Inventor: Stefan Hauttmann, Buchholz (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 308 days.

(21) Appl. No.: 12/670,137

(22) PCT Filed: Jul. 17, 2008

(86) PCT No.: PCT/IB2008/052868

§ 371 (c)(1),
(2), (4) Date: Jan. 22, 2010

(87) PCT Pub. No.: WO2009/013677

PCT Pub. Date: Jan. 29, 2009

(65) Prior Publication Data

US 2010/0195797 A1 Aug. 5, 2010

(30) Foreign Application Priority Data

Jul. 24, 2007 (EP) ..... 07113050

(51) Int. Cl.
*H01J 35/06* (2006.01)

(52) U.S. Cl. ..... 378/136

(58) Field of Classification Search ..... 378/119, 378/121, 136, 141; 313/310, 341
See application file for complete search history.

(56) References Cited

U.S. PATENT DOCUMENTS

| | | | |
|---|---|---|---|
| 6,426,587 | B1 | 7/2002 | Hell et al. |
| 6,464,551 | B1 | 10/2002 | Lipkin et al. |
| 6,646,366 | B2 | 11/2003 | Hell et al. |
| 2003/0025429 | A1 | 2/2003 | Hell et al. |
| 2006/0233307 | A1 | 10/2006 | Dinsmore |

FOREIGN PATENT DOCUMENTS

| | | |
|---|---|---|
| DE | 1211725 | 3/1966 |
| DE | 10135995 A1 | 2/2003 |

*Primary Examiner* — Jurie Yun

(57) ABSTRACT

A thermionic electron emitter (1) is proposed comprising an inner part (2) including a heatable flat emission surface (3) and an outer part (4) including a surrounding surface (6) substantially enclosing the emission surface and a heating arrangement for heating the emission surface to a temperature for thermionic electron emission. The outer part is mechanically connected to the inner part in a connection region (10) apart from the emission surface. Furthermore, the surrounding surface is thermally isolated, e.g. by a gap (14), from the emission surface in an isolation region apart from the connection region. By providing a surrounding surface enclosing the emission surface which may be on a similar electrical potential as the emission surface but which can have a substantially lower temperature than the emission surface without influencing the temperature distribution within the emission surface, an improved electron emission distribution and homogeneity can be obtained.

9 Claims, 7 Drawing Sheets

THERMIONIC ELECTRON EMITTER AND X-RAY SOURCE INCLUDING SAME

FIELD OF THE INVENTION

The present invention relates to a thermionic electron emitter for emitting electrons by thermionic emission and an X-ray source including such thermionic electron emitter.

TECHNICAL BACKGROUND

Future demands for high-end CT (computer tomography) and CV (cardio vascular) imaging regarding the X-ray source are higher power/tube current, shorter response-times regarding the tube current, especially when pulse modulation is desired, and smaller focus spots corresponding to the demands of future detector systems.

One key to reach higher power in smaller focus spots may be given by using a sophisticated electron-optical concept. But of the same importance may be the electron source itself and the starting conditions of the electrons. For a thermionic electron emitter for X-ray tubes it may be essential to heat up a metal surface to get electron emission currents of up to 1-2 A. These electron currents within the tube may be necessary for state-of-the-art medical applications. For today's high-end X-ray tubes, directly or indirectly heated thin flat emitters are usually used.

FIGS. 1*a* and 1*b* show examples of conventional directly heated thin flat emitters 101, 201 having a rectangular or circular geometry, respectively. The flat electron emission surface 103, 203 is structured to define an electrical path and to obtain the required high electrical resistance. The thin emitter film is fixed at connection points 105, 205 to terminals 107, 207 through which an external voltage can be applied to the structured emission surface in order to induce a heating current for heating the emission surface to temperatures for thermionic electron emission.

As can be seen in FIG. 2, the electron emitter 101 may be mounted with its terminals 107 to a cathode cup 111. For directly heated electron emitters, insulators 113 are set between the terminals 107 and the cathode cup 111 to obtain an electrical circuit for applying electrical current to the electron emitter. Such insulators are not necessary for indirectly heated emitters that are heated e.g. by electron bombardment or by laser irradiation.

The exact position of the upper cathode cup surface 115 with respect to the emission surface 103 may be essential for a well-defined electron focusing behaviour of the cathode cup. However, the temperature of the electron source including the electron emitter and the cathode cup may influence the distance between the emission surface 103 and the cathode cup surface 115. During a medical investigation with a series of X-ray pulses, the temperatures of the terminals 107, 207 and of the cathode cup 111 may change differently. As a consequence, different thermo-mechanical expansions may occur and cause a change in the relative positions between emission surface 103 and upper cathode cup surface 115.

This is illustrated in FIGS. 3*a*, 3*b*. During first pulses, terminals 107 and cathode cup 111 are on temperatures that result in a setup as shown in FIG. 3*a*. Different positions between the emission surface 103 and the cathode cup surface 115 lead to a bending of the equipotential-lines of the electrical field 117. This bending focuses the beam of electrons 119 which is emitted from the emission surface 103. At the end of a series of X-ray pulses, a different temperature distribution may be established. In FIG. 3*b* the resulting final positions in case of the terminals 107 being on a higher temperature and hence have a larger expansion is shown. The distance between the upper emission surface 103 and the cathode cup surface 115 is reduced. As a result, the electrical field is not bended as strongly as in the former case. Therefore, a different optical behaviour of the entire electron source is given. The focal spot size and shape on the anode may be changed which may lead to a decrease in optical quality, e.g. the spatial resolution.

In other words, the thermal situation may change while doing several serial X-ray pulses. Therefore, the positions of emission surface 103 and cathode cup surface 115 may change which may lead to a different potential characteristics and a different optical situation. The focal spot on the electron beam on the anode may change which may cause a reduction in optical quality of an X-ray photograph.

In DE 10135995 A1, an electron emitter design as shown in FIG. 4 is presented that may reduce this negative influence. A directly heated thermionic flat emitter 301 has a circular emission surface 303 which is subdivided into current paths 304 which are separated by the slits 305 and which are connected to terminals 307. A number of additional segments 309 are connected by respective narrow webs 311 to the outermost interconnects of the emitter but have no connections to one another due to gaps 313.

As can be seen in FIGS. 5*a* and 5*b*, the result of the design shown in FIG. 4 may be that a thermal expansion of the terminals 307 shifts the emitting inner emission surface 303 and the colder outer emitter parts with the protruding segments 309 in the same way. I.e., the upper surfaces of both parts are always in-plane. With regard to the electron emission accordingly, this design may geometrically separate the area of bended electrical potential lines 317 and the electron emitting area 303. Accordingly, a change in the bended potential lines may not have a significant influence on the optical properties of the X-ray source anymore.

However, practical use has revealed that also the electron emitter design described in DE 10135995 A1 may have problems concerning the distribution and homogeneity of an emitted electron beam.

There may be a need for an improved thermionic electron emitter and an X-ray source including same providing an improved electron emission characteristics allowing an improved electron emission homogeneity and/or a decreased temperature dependency.

SUMMARY OF THE INVENTION

This need may be met by the subject-matter according to the independent claims. Advantageous embodiments of the present invention are described in the dependent claims.

According to a first aspect of the present invention, a thermionic electron emitter is proposed comprising an inner part including a heatable flat emission surface, an outer part including a surrounding surface substantially enclosing the emission surface and a heating arrangement for heating the emission surface to a temperature for thermionic electron emission. Therein, the outer part is mechanically connected to the inner part in a connection region remote from the emission surface. Furthermore, the surrounding surface is thermally isolated from the emission surface in an isolation region remote from the connection region.

It has been found by the inventor of the present invention that in thermionic electron emitters similar to those disclosed in DE 10135995 A1 and shown in FIG. 4, the additional protruding segments 309 which are directly attached to the electron emission surface 303 may act like heat sinks due to the fact that they are not heated by electrical current but release energy by radiation. Therefore, the temperature within the directly heated current path within the actual emission surface may be significantly influenced by the additional protruding segments. For example, in the regions adjacent to the webs 311, the temperature in the emission surface 303 may be reduced locally. Accordingly, the electron emission characteristics may be drastically disturbed which also may cause a significant negative change in the focal spot intensity distribution and optical quality of the X-ray system. For example, the local change in temperature could reach values in the range of $\Delta T=100°$ C. at a temperature for thermionic electron emission of $T=2200°$ C. for realizable and mechanically stable emitter designs. One approach to eliminate this influence may be to reduce the width of the small webs 311 in order to reduce thermal conduction between the emission surface 303 and the external segments 309. However, such reduced web size may result in a mechanical connection between the external segments 309 and the emission surface 303 being not stable under external forces like the centrifugal force on CT-gantries any more. Additionally, the influence on the temperature distribution and electron emission characteristic may be temperature dependent due to the temperature dependence of the radiation, heat capacity and heat conduction. Thus, the X-ray system has to handle this complex influence when changing the emission current for different medical applications. Furthermore, any kind of slits within or close to the emission surface 303 of the emitter may lead to deformations in the high voltage field which may result in larger focal spot sizes. Summarized, the disturbance of the temperature within the electron emitting area and the influence of the slits close to the emission surface may be disadvantageous which, at least in part, may be overcome by the present invention.

The first aspect of the present invention may be seen as based on the idea to provide an outer emitter part which, during operation, is not actively heated and which surrounds or encloses the actual heated or heatable flat emission surface of an inner emitter part wherein the outer emitter part is mechanically connected to the inner emitter part remote from the heatable emission surface and therefore substantially has no direct thermal contact to a hot emission surface in operation.

For example, an intermediate region can be interposed between the emission surface actually heated by the heating arrangement to a temperature for thermionic electron emission, which may be more than 2.000° C., and the non-heated outer part including the surrounding surface. This intermediate region may act as a thermal barrier or insulator such that heat exchange between the emission surface of the inner part and the surrounding surface of the outer part is substantially prevented. However, apart from the lacking thermal contact, there may be electrical contact between the inner part and the outer part such that the emission surface and the surrounding surface may be on a similar electrical potential.

The gist of the thermionic electron emitter according to the first aspect of the present invention may be seen in the fact that the outer part including the surrounding surface is mechanically connected to the inner part including the emission surface in a manner such that substantially no influence to the temperature distribution within the emission surface occurs when the emission surface is heated by the heating arrangement whereas the outer part is not heated by the heating arrangement. Accordingly, the temperature distribution within the heated emission surface of the electron emitter according to the first aspect of the invention may be substantially equal to the temperature distribution of a heated emission surface of the same geometry of a conventional thermionic electron emitter having no additional outer parts.

In the following, possible features and advantages of the thermionic electron emitter according to the first aspect will be explained in detail.

Herein, a thermionic electron emitter may be interpreted as having an electron emission surface which, during operation, is heated by a heating arrangement to a very high temperature of for example more than 2.000° C. for thermionic electron emission such that electrons in the emission surface have such high kinetic energy as to emanate from the emission surface. The released electrons can then be accelerated within an electrical field and can be directed onto an anode in order to generate X-rays.

The emission surface of the inner part is generally flat which means that there are substantially no curvature or protrusions within the emission surface which might disturb or deviate the electrical potential applied between the electron emitter and an anode. However, the emission surface may be structured such as to define conduction paths of predetermined electrical resistance. By applying an external voltage to end terminals on these conduction paths, a current may be induced within the conduction paths for heating the emission surface.

The surrounding surface of the outer part substantially encloses the emission surface entirely. For example, the surrounding surface may be formed as a ring-like surface laterally around the rectangular or circular emission surface. In order to avoid electrical currents flowing through the outer part, the surrounding surface may be interrupted by small gaps in the order of less than 1 mm, preferably less than 400 μm. Such gaps may prevent any electrical current flowing through the outer part while, due to their small size, not substantially influencing the electrical potential between the electron emitter and an anode and while not substantially influencing a thermal characteristics of the surrounding surface.

The heating arrangement for heating the emission surface may be realized in different manners. In so-called directly heated thermionic electron emitters, the heating arrangement may be integrated into the inner part of the electron emitter. As mentioned before, terminals may be provided on the inner part and the inner part may be structured to have electrical conduction paths such that electrical current flowing through these paths heats the emission surface. Alternatively, in so-called indirectly heated electron emitters, an external heating arrangement can be provided. For example, accelerated electrons from an auxiliary electron source may be directed onto the emission surface of the electron emitter in order to heat it by electron bombardment. Alternatively, a source of intense light such as a laser may be directed onto the emission surface for heating same by light absorption.

The connection region in which the outer part is mechanically connected to the inner part should be sufficiently remote from the emission surface such that no substantial thermal contact between the outer surface and a hot emission surface is provided. The actual distance between the heated emission surface and the non-heated surrounding surface of the outer part may be selected depending on the thermal properties of the material of for example the inner part, the outer part and/or the connection region. Less than a few millimeters of distance between the outer part and the emission surface may be sufficient for practical purposes of thermal separation.

In order to prevent negative thermal influence of the surrounding surface to the hot emission surface in operation, the surrounding surface should be thermally isolated from the emission surface as good as possible. For this purpose, the surrounding surface should be isolated from the emission surface at least in the isolation region remote from the connection region where the outer part is connected to the inner part. In other words, the surrounding surface should be close to the emission surface and enclose the emission surface but there should not be significant thermal contact between the hot emission surface and the cold surrounding surface (except for the unavoidable thermal radiation contact).

According to an embodiment of the invention, the surrounding surface, in the isolation region, is laterally spaced apart from the emission surface by a gap. This gap may serve for thermal isolation. For example, this gap may have a width of less than 1 mm, preferably less than 0.4 mm and more preferably less than 0.2 mm. The smaller the gap the smaller disturbances of the electrical field may be. Preferably, the gap may have a constant width along its longitudinal extension in order to reduce inhomogeneities in electric field deviations and/or thermal properties.

According to a further embodiment, the heating arrangement comprises two emitter terminals arranged at the inner part at opposing positions with respect to the emission surface such that an electrical heating current can be induced in the emission surface by applying a voltage to the emitter terminals. In this embodiment, the emission surface can be directly heated. The location at which the emitter terminals contact the inner part of the electron emitter may define the lateral extremities of the heatable emission surface. Due to radiation losses, conduction losses and convection losses, these extremities may be the coldest areas of the heated emission surface. Accordingly, it may be advantageous to mechanically connect the unheated outer part to the inner part at proximity to these extremities.

According to a further embodiment, the outer part is mechanically connected to the inner part in a connection region opposite to the emission surface with respect to an emitter terminal. In other words, in a directly heated electron emitter, the region between two emitter terminals serves as heatable emission surface whereas the opposite region outside the emission surface may serve as connection region in which the outer part can be mechanically connected to the inner part.

In a further embodiment of the inventive electron emitter, the heating arrangement comprises a laser beam source or an electron beam source directed to the emission surface. In this embodiment, the emission surface can be heated indirectly by light absorption of the laser beam or by electron bombardment. The shape and size of the beam defines the actually heated emission surface. Accordingly, knowing these properties of the laser beam or the electron beam it can be determined which regions of the inner part will be heated during operation and which parts remain relatively cold such that the outer part can be mechanically connected to these non-heated regions of the inner part.

According to a further embodiment of the electron emitter the inner part and the outer part are integrally formed from the same material such as for example a metal, a metal alloy or a metal sandwich combination. Suitable materials can be for example tungsten, tantalum and tungsten rhenium alloy. Forming the inner part and the outer part integrally from a common substrate may at the same time improve producibility and mechanical stability of the electron emitter. Furthermore, as the entire electron emitter is formed from an electrically conductive material, the inner part and the outer part are in electrical connection. Furthermore, being of the same material, all parts of the electron emitter have the same coefficient of expansion which may be advantageous in high temperature environments.

According to a further embodiment of the electron emitter, the inner part and the outer part are realized as separate devices wherein the outer part is attached to the inner part distant from the emission surface. For example, the inner part can be made from a first high temperature resistant material and may comprise the emission surface to be heated in operation in the centre and a border region not to be heated. The outer part can comprise a different material which is not necessarily high temperature resistant and can be attached to the border region of the inner part.

According to a further embodiment, the emission surface of the inner part and the surrounding surface of the outer part are arranged in a same plane. In such arrangement, the electron emitter can be fabricated for example from a simple flat film or sheet substrate wherein the surrounding surface is separated from the heatable emission surface only by small slits or gaps which may be fabricated for example by lasering or wire erosion. The thickness of such sheet may be for example in the range of a few hundred micrometers. Having a completely flat surface including the emission surface and the surrounding surface, an electron emitter according to this embodiment may be advantageous in order to obtain an undistorted electrical field between the emission surface and a remote anode.

According to a further embodiment, the surrounding surface extends out of the plane of the emission surface. For example, the surrounding surface can be laterally continuous to the emission surface in a region directly adjacent to the emission surface but then bent out of the plane of the emission surface. Alternatively, the outer part including the surrounding surface can for example be attached on top of the border region of the inner part such that the surrounding surface extends in a plane parallel to the plane of the emission surface. Such different geometries of the surrounding surface may allow different electron-optical behaviours of the electron emitter.

According to a second aspect of the invention, an X-ray source including a thermionic electron emitter as described above is provided. Due to the advantageous properties of the thermionic electron emitter such as homogeneous electron emission, the X-ray source may reveal superior properties with respect to X-ray beam homogeneity, achievable tube current, achievable minimal focal spot size and achievable minimal response time. Apart from the inventive electron emitter, the X-ray source may comprise an anode to establish an electrical field between the electron emitter serving as a cathode and a target for generating the X-ray beam. Furthermore, electron optics may be provided.

It has to be noted that embodiments of the invention are described with reference to different subject matters. In particular, some embodiments are described with reference to the electron emitter whereas other embodiments are described with reference to the X-ray source. However, a person skilled in the art will gather from the above and the following description that, unless other notified, in addition to any combination of features belonging to one type of subject matter also any combination between features relating to different subject matters is considered to be disclosed with this application.

The aspects defined above and further aspects, features and advantages of the present invention can be derived from the examples of embodiments to be described hereinafter and are explained with reference to the examples of embodiment. The invention will be described in more detail hereinafter with reference to examples of embodiment but to which the invention is not limited.

BRIEF DESCRIPTION OF THE DRAWINGS

The illustration in the drawings is schematically only. It is noted that in different figures, similar or identical elements are provided with the same reference signs or with reference signs which are different from the corresponding reference signs only within the first digit.

DETAILED DESCRIPTION OF PREFERRED EMBODIMENTS

Figure 1A:
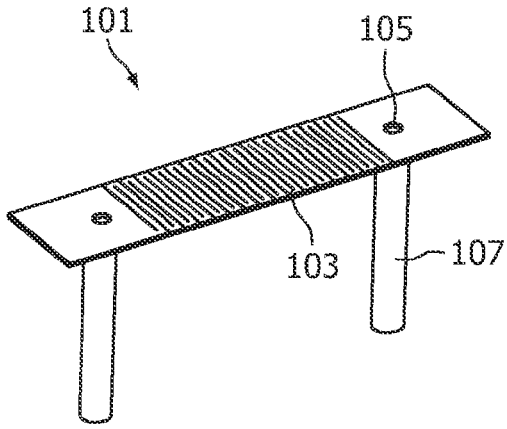
FIG. 1a (prior art)
FIGS. 1*a*, 1*b* show prior art thermionic electron emitters.
Figure 1B:
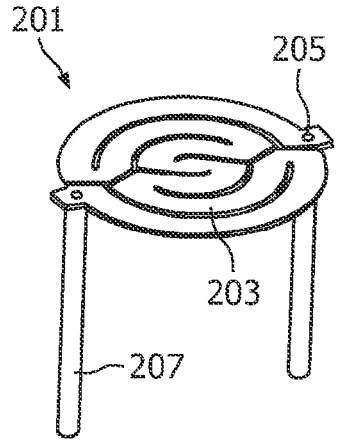
FIG. 1b (prior art)
Figure 2:
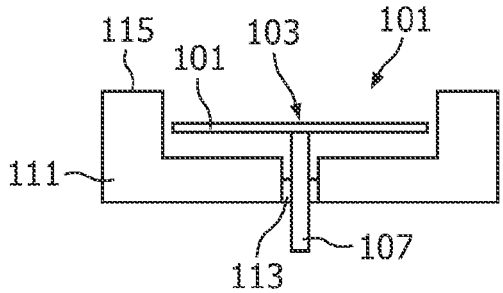
FIG. 2 (prior art)
FIG. 2 shows a prior art arrangement of an electron emitter within a cathode cup.
Figure 3A:
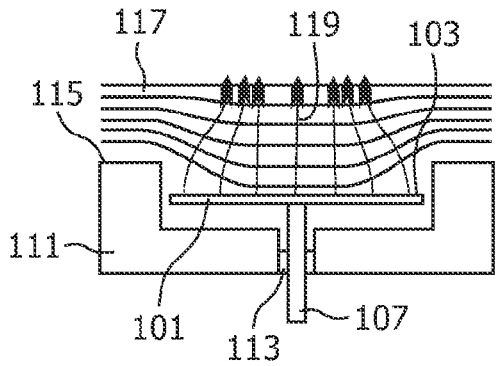
FIG. 3a (prior art)
FIGS. 3*a*, 3*b* illustrate the change in an electrical field above the arrangement of FIG. 2 due to different thermal expansions of a terminal supporting the electron emitter.
Figure 3B:
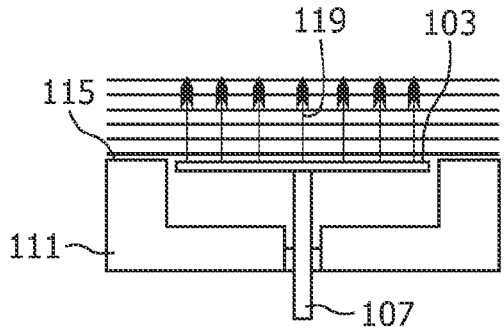
FIG. 3b (prior art)
Figure 4:
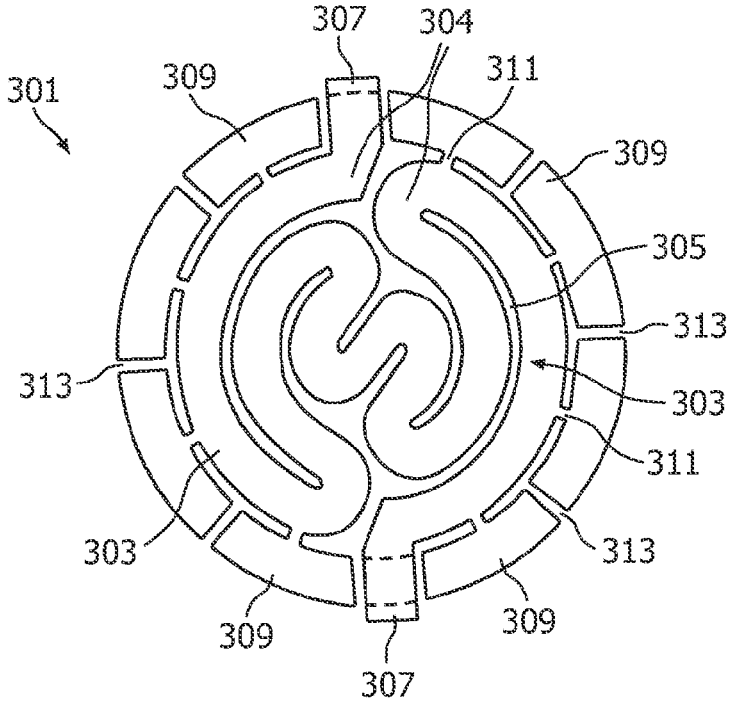
FIG. 4 (prior art)
FIG. 4 shows a prior art thermionic electron emitter having additional non-heated segments in an outer most region attached to an inner region of the electron emitter defining the emission surface.
Figure 5A:
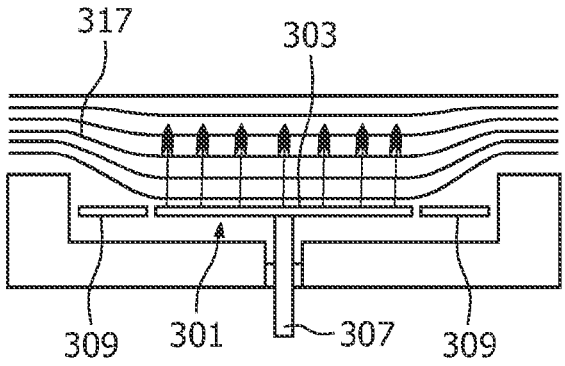
FIG. 5a (prior art)
FIGS. 5*a*, 5*b* illustrate different configurations of the electrical field for different states of thermal expansion of a terminal supporting the electron emitter shown in FIG. 4.
Figure 5B:
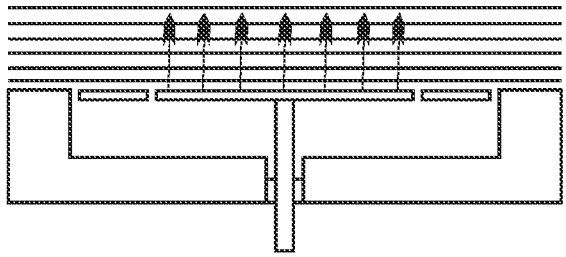
FIG. 5b (prior art)
Figure 6:
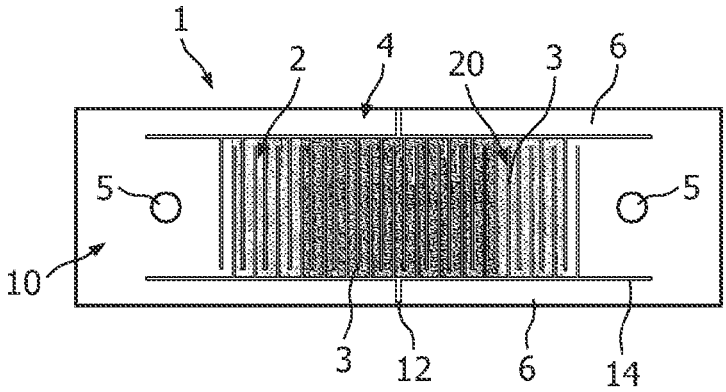
FIG. 6 shows a top view of a rectangular thermionic electron emitter according to an embodiment of the present invention.

FIG. 6 shows a top view of a thermionic electron emitter 1 according to a first embodiment of the invention. The electron emitter 1 comprises an inner part 2 and an outer part 4 substantially enclosing the inner part 2. On the inner part 2, connection points 5 are provided which are to be connected with terminals for applying an external voltage to a region between lateral extremities of the inner part, this intermediate region serving as heatable flat emission surface 3.

In the drawing, the emission surface 3 is shown with different hatchings wherein a dense hatching indicates a higher temperature during operation when a current is flowing through the emission surface whereas a less dense hatching indicates a lower temperature during operation. It can be seen that at the centre between the two connection points 5 there is the highest temperature whereas in the border regions the temperature remains lower.

Accordingly, the terminals connected to the connection points 5 and the structured emission surface in between the connection points 5 serve as a heating arrangement 20 for heating the emission surface 3 to a temperature for thermionic electron emission. The connection points 5 itself define the border of the emission surface. Between the two connection points 5 the surface of the inner part 2 is actively heated by inducing electrical heating current within the emission surface which is structured to small conduction paths. Outside this emission surface, i.e. at a region opposite to the emission surface with respect to the connection points 5, the inner part 2 is not actively heated and is therefore significantly cooler than within the emission surface. This cooler region outside and remote from the emission surface 3 can be used as connection region 10 for mechanically connecting the outer part 4 to the inner part 2.

In the embodiment of FIG. 6, the thermionic electron emitter 1 has a rectangular shape and the outer part 4 and the inner part 2 are fabricated from a single metal sheet. The surrounding surface 6 surrounding the emission surface 3 is provided as longitudinal rectangular tongues which extend from a lateral end of the electron emitter (in the figure from the left end and from the right end) to its lateral centre. These tongues are electrically connected to the inner part in the connection region 10 being itself not actively heated. Accordingly, the surrounding surface may be on a similar potential as one of the connection points 5 and can be on a significantly lower temperature than the emission surface 3 without disturbing the temperature distribution within the heated emission surface 3.

In order to prevent an electrical current to flow from a left side connection point 5 via the outer part 4 to a right side connection point, the outer part 5 is separated by a gap 12 in its middle section. This gap may have a width of about 0.5 mm. Furthermore, in order to prevent both a short circuit between the emission surface 3 and the surrounding surface 6 of the outer part 4 and to prevent thermal contact between the emission surface and the surrounding surface, a narrow slit is formed within the electron emitter partly separating the emission surface 3 from the surrounding surface 6 by a gap 14.

Figure 7:
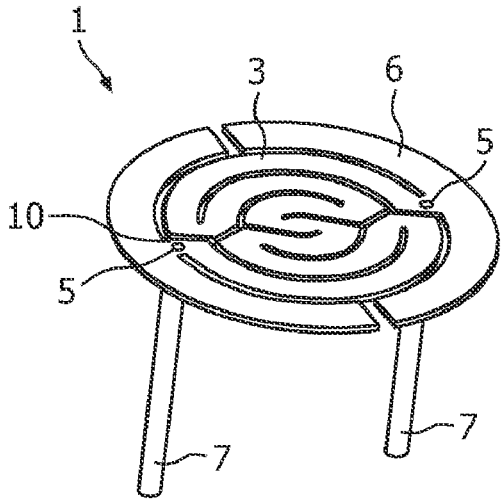
FIG. 7 shows a circular thermionic electron emitter according to an embodiment of the present invention.

FIG. 7 shows an alternative thermionic electron emitter 1 according to another embodiment of the present invention having a round geometry. In this embodiment, the heated emission surface 3 is circular and the surrounding surface 6 encloses the emission surface 3 in half-circles. As can be seen in the perspective view of FIG. 7, terminals 7 are connected to the connection points 5. The half-circles of the surrounding surface 6 are mechanically connected to the inner emission surface 3 at a connection region 10 radially outside the emission surface 3.

Figure 8:
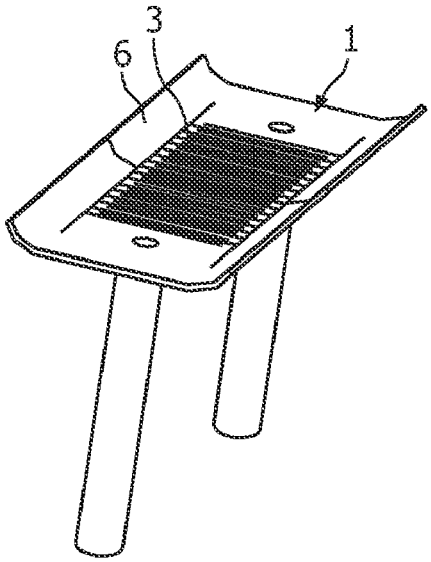
FIG. 8 shows a thermionic electron emitter having upwardly bent surrounding surfaces according to an embodiment of the present invention.
Figure 9:
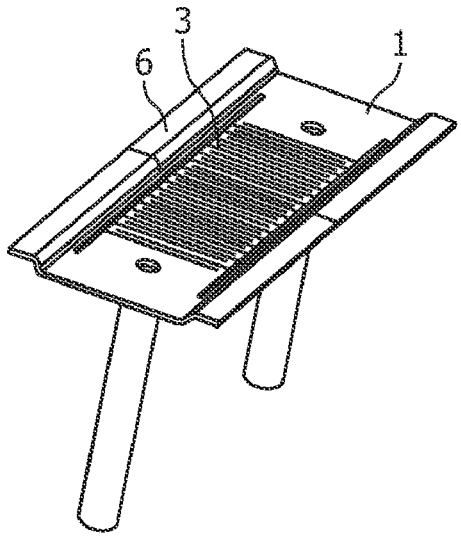
FIG. 9 shows another thermionic electron emitter having step-like surrounding surfaces according to another embodiment of the present invention.

FIGS. 8 and 9 show further embodiments of a thermionic electron emitter fabricated from a single metal sheet. In the embodiment of FIG. 8, the surrounding surface 6 is bent upwardly in order to extent out of the plane of the flat emission surface 3. In the embodiment shown in FIG. 9, the surrounding surface 6 is formed in a step-like fashion such that the main part of the surrounding surface 6 is parallel shifted to the plane of the emission surface 3. Using such differently formed surrounding surfaces, specific electron-optical properties of the electron emitter can be achieved.

Figure 10:
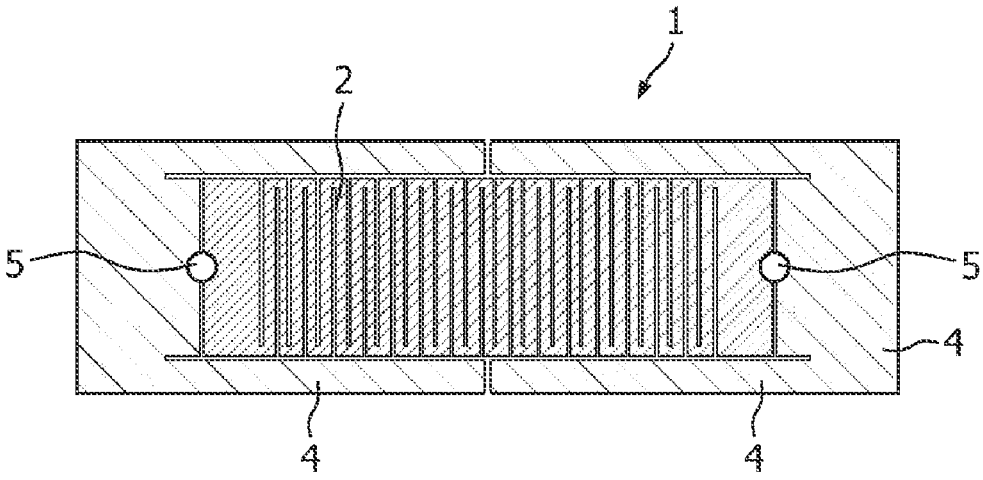
FIG. 10 shows a top view of a thermionic electron emitter comprising different materials for the inner and outer part according to another embodiment of the present invention.

In the embodiment shown in FIG. 10, the inner part 2 and the outer part 4 are provided with different materials indicated by different types of hatching in the figure. In such an embodiment, the materials and their properties like e.g. the thermal conductivity, the thermal expansion coefficient and the electron emissivity could be different. In such an embodiment it may be advantageous to fix the inner part and the outer part to the same end region of the terminals (not shown in the top view of FIG. 10) at the connection points 5 in a way that they have only a slight distance to each other. This leads to a negligible change in distance while heating the structure.

With such a setup it is ensured that the surface of the emitting part and the surrounding outer part shift in the same way when temperature changes occur.

Figure 11:
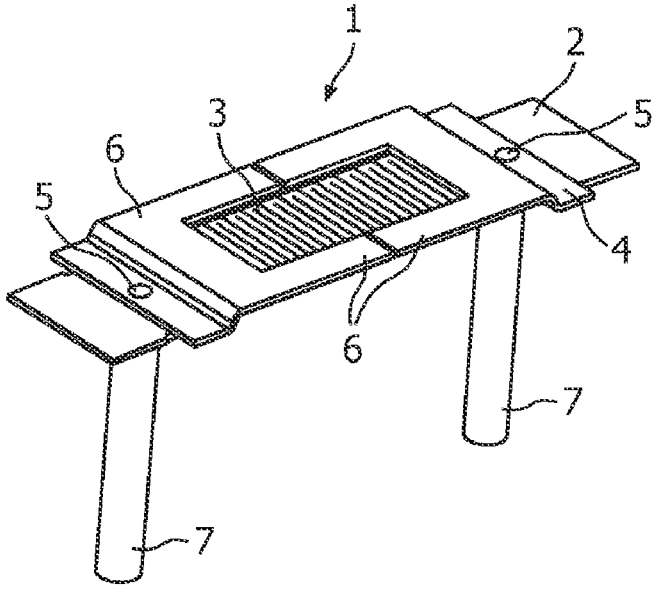
FIG. 11 shows a thermionic electron emitter having separate devices for the inner part and the outer part according to another embodiment of the present invention.

FIG. 11 shows an embodiment of the thermionic electron emitter in which the inner part 2 comprising the emission surface 3 and the outer part 4 comprising the surrounding surfaces 6 are provided as separate devices. The outer part 4 is attached onto the connection points 5 where the inner part 2 is connected to the terminals 7. The surrounding surface 6 of the outer part 4 is shifted perpendicularly with respect to the emission surface 3 and can have an overlap with the emission surface 3. For example, the device forming the outer part 4 can be provided as having an opening in the middle which may act as an aperture and may contactlessly cover zones of the emission surface 3. These covered zones are still emitting electrons which however are not injected into the high voltage field.

Figure 12:
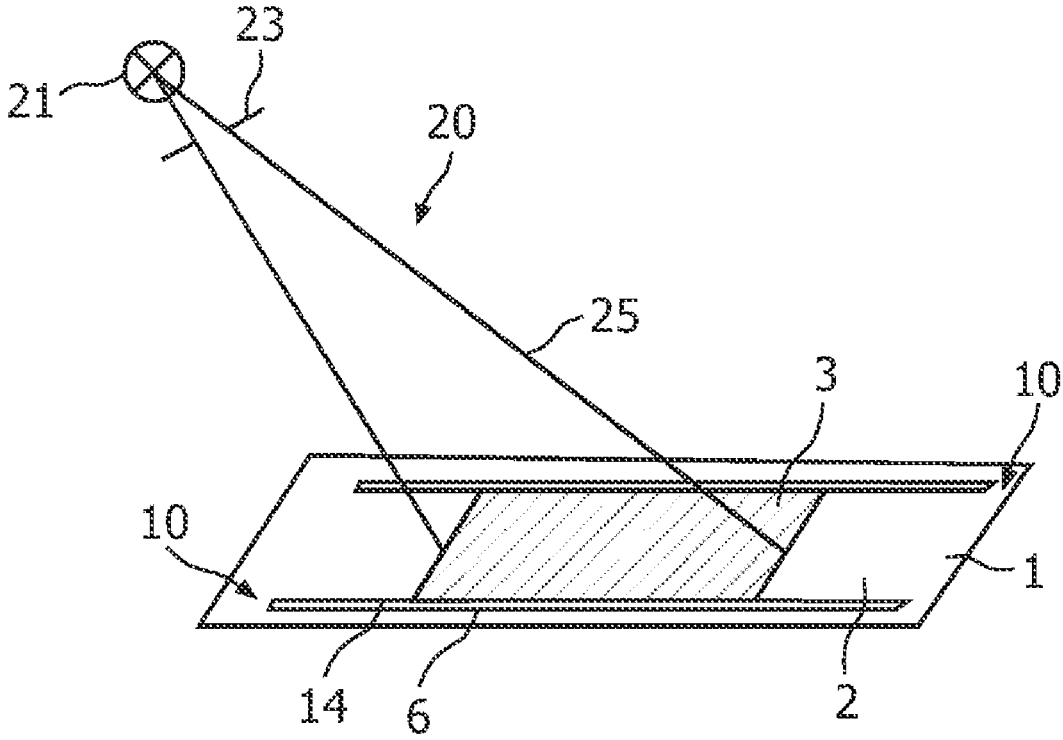
FIG. 12 schematically shows a thermionic electron emitter indirectly heated by an external laser beam according to another embodiment of the present invention.

FIG. 12 shows an embodiment of the thermionic electron emitter wherein the emission surface is indirectly heated by a heating arrangement (20) including an external laser source 21. A light beam coming from the laser source 21 is shaped by an aperture 23 and possibly by further optical means (not shown in the figure) such that the light beam 25 irradiates a region within the inner part of the thermionic electron emitter 1 thus serving as heated emission surface 3. The outer part 4 is separated from the irradiated emission surface 3 by a gap 14 and is connected to the inner part 2 only in a border region 10 remote from the heated emission surface 3. Provision for absorbing different elongations of the heated inner part 2 and the non-heated outer part 4 due to their different thermal expansion coefficients can be made.

Figure 13:
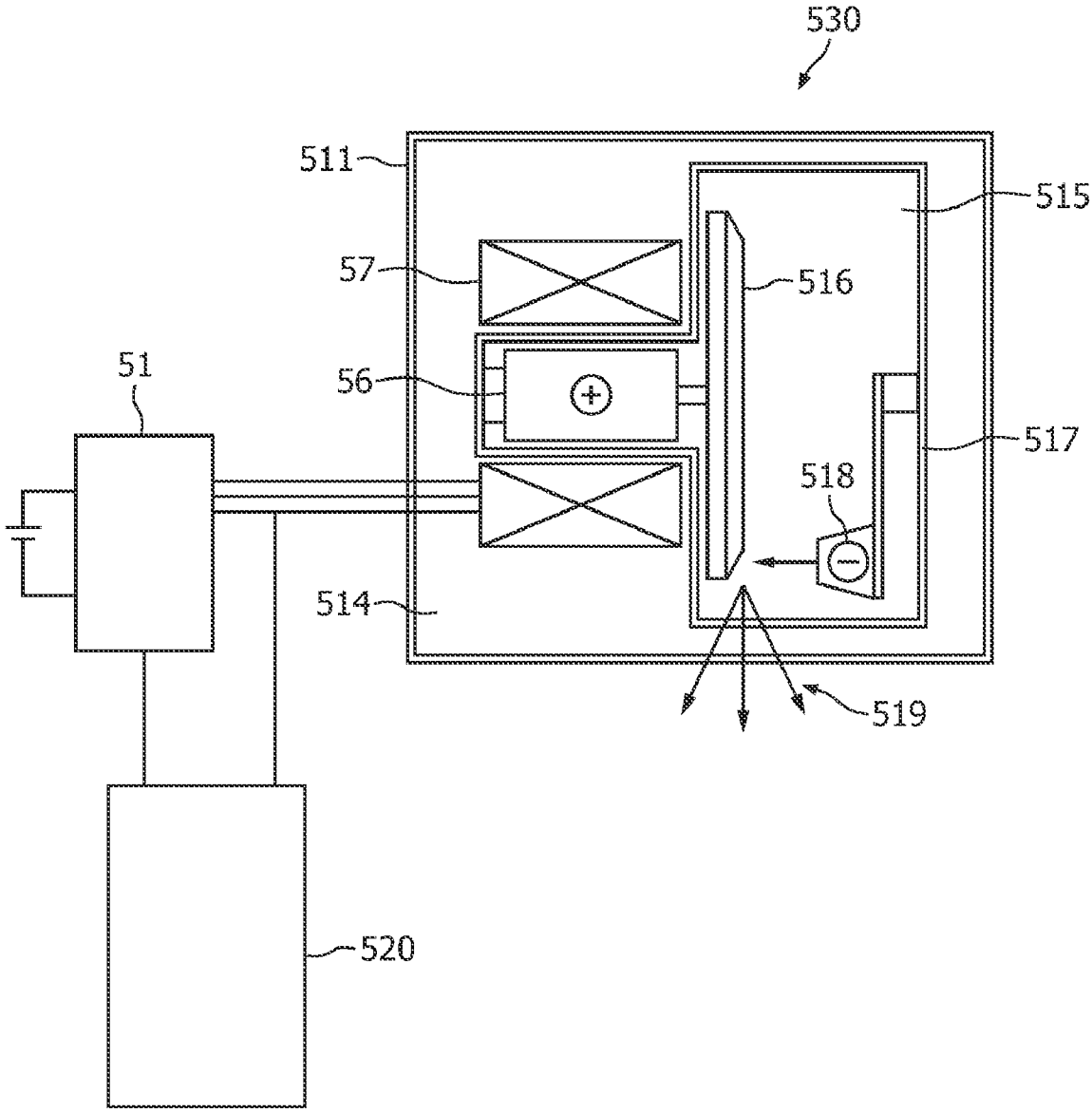
FIG. 13 schematically shows an X-ray tube according to an embodiment of the present invention.

FIG. 13 shows an X-ray tube 530 with a rotary anode 516 driven by an asynchronous machine. The X-ray tube 530 consists of a cathode 518 and a rotary anode 516 within the vacuum 515 of an envelope 517. Electrons are accelerated from the cathode 518 to the rotary anode 516 and collide with the rotary anode 516 as the metal target. By colliding with the metal target X-ray photons 519 are emitted from the rotary anode 516. To avoid a focal spot of the colliding electrons on the rotary anode 516 the rotary anode 516 is a rotatable plate connected to a shaft of a rotor 56 of an asynchronous machine. By using a rotary anode 516 the focal spot is averaged along the edge of the plate, which results to a long durableness of the rotary anode 516 and allows a high energy electron beam. The envelope 517 is enclosed in a housing 511, which is filled with oil 514 cooling the X-ray tube 530 and which comprises the stator 57 of the asynchronous machine. The stator 57 is connected to an electrical supply 51. The three-phase stator current causes a rotating electromagnetic field, which leads to the rotation of the rotor 56 and thus the rotary anode 516. Using an asynchronous machine at least one phase of the stator current may be measured. The measured current signal is processed in the device 520 and the mechanical rotor frequency and thus the rotary anode velocity is calculated. Thus, the operation of the X-ray tube 530 can be optimized.

In a non-limiting attempt to recapitulate the above-described embodiments of the present invention one could state: the core of the invention may be seen in substituting those parts of the cathode cup which are relevant for the emission and focusing behaviour of the emitting flat emitter parts and which are influenced from different thermal expansion of the cup body and terminals by thin metal sheets which may be fixed to the same terminals as the emitting flat emitter part but kept on a lower, non-emitting temperature. All temperature changes within such a cathode setup lead to the same shift of the emitting part and the additional part and the well-defined relative position of both parts which significantly influences the electron emitter and the optical characteristics, maintains.

It should be noted that the term "comprising" does not exclude other elements or steps and the "a" or "an" does not exclude a plurality. Also elements described in association with different embodiments may be combined. It should also be noted that reference signs in the claims should not be construed as limiting the scope of the claims.

The invention claimed is:

1. A thermionic electron emitter comprising:

an inner part including a heatable flat emission surface;

an outer part including a surrounding surface substantially enclosing the emission surface;

a heating arrangement for heating the emission surface to a temperature for thermionic electron emission;

wherein the outer part is mechanically connected to the inner part in a connection region apart from the emission surface;

wherein the surrounding surface is thermally isolated from the emission surface in an isolation region apart from the connection region;

wherein the surrounding surface is laterally spaced apart by a gap from the emission surface in the isolation region;

wherein the heating arrangement comprises two emitter terminals arranged at the inner part at opposing position with respect to the emission surface such that an electrical heating current can be induced in the emission surface by applying a voltage to the emitter terminals;

wherein the outer part is mechanically connected to the inner part in a connection region opposite to the emission surface with respect to an emitter terminal;

wherein the inner part and the outer part are each formed from a different material being one of a metal, a metal alloy and a metal sandwich combination, wherein the inner part and the outer part are fixed to the same end region of the terminals.

2. The thermionic electron emitter according to claim 1, wherein the heating arrangement comprises one of a laser beam source and an electron beam source directed to the emission surface.

3. An X-ray source comprising a thermionic electron emitter according to claim 1.

4. A thermionic electron emitter comprising:

an inner part including a heatable flat emission surface;

an outer part including a surrounding surface substantially enclosing the emission surface;

a heating arrangement for heating the emission surface to a temperature for thermionic electron emission;

wherein the outer part is mechanically connected to the inner part in a connection region apart from the emission surface;

wherein the surrounding surface is thermally isolated from the emission surface in an isolation region apart from the connection region;

wherein the surrounding surface is laterally spaced apart by a gap from the emission surface in the isolation region;

wherein the heating arrangement comprises two emitter terminals arranged at the inner part at opposing position with respect to the emission surface such that an electrical heating current can be induced in the emission surface by applying a voltage to the emitter terminals;

wherein the outer part is mechanically connected to the inner part in a connection region opposite to the emission surface with respect to an emitter terminal;

wherein the inner part and the outer part are realized as separate devices, wherein the outer part is attached to the inner part distant from the emission surface, wherein the surrounding surface of the outer part is shifted perpendicularly with respect to the emission surface, and wherein the surrounding surface of the outer part is shifted perpendicularly with respect to the inner part forming an aperture so that the inner part contactlessly covers zones of the emission surface.

5. The thermionic electron emitter according to claim 4, wherein the heating arrangement comprises one of a laser beam source and an electron beam source directed to the emission surface.

6. An X-ray source comprising a thermionic electron emitter according to claim 4.

7. A thermionic electron emitter comprising:

an inner part including a heatable flat emission surface;

an outer part including a surrounding surface substantially enclosing the emission surface;

a heating arrangement for heating the emission surface to a temperature for thermionic electron emission;

wherein the outer part is mechanically connected to the inner part in a connection region apart from the emission surface;

wherein the surrounding surface is thermally isolated from the emission surface in an isolation region apart from the connection region;

wherein the surrounding surface is laterally spaced apart by a gap from the emission surface in the isolation region;

wherein the heating arrangement comprises two emitter terminals arranged at the inner part at opposing position with respect to the emission surface such that an electrical heating current can be induced in the emission surface by applying a voltage to the emitter terminals;

wherein the outer part is mechanically connected to the inner part in a connection region opposite to the emission surface with respect to an emitter terminal;

wherein the surrounding surface forms a step shifted perpendicularly out of the plane of the emission surface such that the main part of the surrounding surface is parallel shifted to the plane of the emission surface.

8. The thermionic electron emitter according to claim 7, wherein the heating arrangement comprises one of a laser beam source and an electron beam source directed to the emission surface.

9. An X-ray source comprising a thermionic electron emitter according to claim 7.

* * * * *